US005542350A

United States Patent [19]

Theilacker et al.

[11] Patent Number: 5,542,350

[45] Date of Patent: Aug. 6, 1996

[54] DRAW-IN DEVICE AND PROCESS FOR FEEDING WEBS OF MATERIAL INTO A PRINTING MACHINE

[75] Inventors: Klaus Theilacker, Friedberg; Rainer Burger, Augsburg, both of Germany

[73] Assignee: MAN Roland Druckmaschinen AG, Offenbach, Germany

[21] Appl. No.: 251,517

[22] Filed: May 31, 1994

[30] Foreign Application Priority Data

Jun. 2, 1993 [DE] Germany ..... 43 18 299.2

[51] Int. Cl.[6] ..... B41F 13/54

[52] U.S. Cl. ..... 101/228; 226/4; 226/28; 226/45; 226/11; 226/30; 242/554.5; 242/563; 242/417; 242/421.5

[58] Field of Search ..... 101/228, 224, 101/225, 227, 248; 226/91, 92, 27, 28, 4, 45, 11, 30; 242/57, 56.9, 75.51

[56] References Cited

U.S. PATENT DOCUMENTS

| | | | |
|---|---|---|---|
| 1,971,771 | 8/1934 | Crafts . | |
| 3,761,001 | 9/1973 | Bolza-Schunemann et al. | 101/228 |
| 3,808,971 | 5/1974 | Staamann | 101/226 |
| 3,995,553 | 12/1976 | Winterholler et al. | 101/228 |
| 4,349,770 | 9/1982 | Ragen | 400/225 |
| 4,404,907 | 9/1983 | Köbler et al. | 101/228 |
| 4,896,605 | 1/1990 | Schröder | 101/228 |
| 5,088,403 | 2/1992 | Shoji et al. | 101/227 |
| 5,117,753 | 6/1992 | Mamberer | 101/225 |
| 5,263,414 | 11/1993 | Lehrrieder et al. | 101/228 |
| 5,397,044 | 3/1995 | Suzumi | 226/92 |

FOREIGN PATENT DOCUMENTS

| | | |
|---|---|---|
| 2241127 | 3/1974 | Germany . |
| 3312038 | 12/1983 | Germany . |
| 421328 | 12/1934 | United Kingdom . |

*Primary Examiner*—Eugene H. Eickholt
*Attorney, Agent, or Firm*—Cohen, Pontani, Lieberman, Pavane

[57] ABSTRACT

A draw-in device for feeding a plurality of printing stock webs, preferably paper webs, in which draw-in elements of finite length grasp the start of a paper web and draw it out of reel changers and draw mechanisms through printing units and up to folding units. An electronic memory is provided in which are stored the lengths of all possible feed paths in the printing machine and the draw-in elements can be switched on at different times corresponding to the different lengths of the feed paths and the resulting time differences at a given feed rate via an electronic computer connected with the memory and can be switched off simultaneously. It is also possible to refeed a web of printing stock which was torn during the print process so as to substantially reduce wasted paper.

17 Claims, 2 Drawing Sheets

DRAW-IN DEVICE AND PROCESS FOR FEEDING WEBS OF MATERIAL INTO A PRINTING MACHINE

BACKGROUND OF THE INVENTION

1. Field of the Invention

The invention is directed to a draw-in device for feeding a plurality of webs of printing stock, preferably paper into a printing machine, and to a process for feeding webs.

2. Description of the Prior Art

A draw-in device in which only one web of printing stock at a time is fed via different feed paths is known from DE 22 41 127 C3. A paper web to be printed can be guided by means of this draw-in device via preadjusted points or switches through the individual printing units of a printing machine in a desired manner, the fed web being attached to a finite, drivable draw-in element.

There are also printing machines in which a plurality of printing stock webs must be printed simultaneously. For this purpose, the material webs are fed in one after another and the entire printing machine runs during the feeding process. Although this process for feeding webs of material saves much time compared with a manual feed, there is a high percentage of waste which occurs, for example, in a printing machine with four adjacent printing unit towers when the fourth material web is drawn into the printing machine after the other three material webs have already been drawn in and must now move along with this fourth material web.

If one attempted to feed in all material webs at the same time in an effort to save time and economize on wasted printing stock, the material webs would arrive at their destinations at different times due to the varying lengths of the feed paths and the different amounts of time accordingly required to travel the feed paths. The first draw-in element to arrive at its destination would cause the entire printing machine to stop. The draw elements, such as cylinders or draw rollers, coming into contact with this material web would then have to be decoupled and the printing machine would then have to be restarted and the rest of the material webs would continue to be fed through until the next shortest material web arrived at its destination and the draw elements associated with this path would be decoupled in a corresponding manner.

Even if it were possible for draw elements associated with one path to be decoupled individually while the draw elements associated with other paths continued to rotate, it would still not be possible to recouple stationary and running paths at the conclusion of the feed process in a search run required for a definite correspondence coupling.

Consequently, it is necessary to consecutively draw in the webs. Accordingly, when the second web is drawn in, the first web moves along with it and when the third web is drawn in the first and second webs move along with it. For example, if the distance covered by a web of printing stock between a reel changer and a cutting mechanism in a printing machine is 35 meters and four webs of printing stock are to be ted one after the other, there is a net feed waste of 350 meters. The time required for the feed of four webs is four times that required for one web of printing stock.

SUMMARY OF THE INVENTION

Accordingly, it is an object of the present invention to provide a draw-in device which allows a rapid feed of webs of printing stock into the printing machine with less waste.

Pursuant to this object, and others which will become apparent hereafter, one aspect of the present invention resides in a draw-in device for drawing in a plurality of webs of printing stock, preferably paper webs, along different feed paths formed by guides and switches lying outside the roller area from reel changers and draw mechanisms into printing units of a printing machine prior to the printing process. This is accomplished by draw-in elements of finite length. The feed paths are adjustable by adjusting means so that the draw-in elements can draw in the printing stock webs on the respective feed paths. The draw-in elements can start at different times corresponding to the differences in length of the feed paths and the resulting time differences at given feed rates as controlled by the adjusting means. The printing stock web traveling the longest feed path is drawn in first and the printing stock web traveling the shortest feed path follows last so that all printing stock webs arrive at and are stopped at the outputs of the printing webs simultaneously.

Instead of achieving simultaneous arrival of the webs of printing stock during the feed process by starting them at different times, it is also possible in another embodiment of the invention to let the webs of printing stock run simultaneously, but at different speeds. For this purpose, the web of printing stock having to travel the longest feed path is fed at the highest speed. This does not presuppose a constant rate of feed throughout the entire feed process. Rather, it is also possible for the web of printing stock having a longer path to travel to be fed in first at a high speed until it reaches the region of the printing units and then to travel, for example, at the same speed as the other web of printing stock which has a shorter feed path to cover. In this way, all printing stock webs arrive at their destinations at the same time.

A third embodiment of the invention comprises means for compensating for differences in length of feed paths so that all feed paths (within allowable tolerances) are of equal length. For this purpose, there are, e.g., stationary rods or rigidly supported rotatable rollers which the webs of printing stock must wind around in addition so that they all travel the same distance and can be fed at equal feed rates. Instead of stationary deflecting means, it is possible to provide rollers which are movable axially to their rotational axes and which can be displaced in various positions corresponding to the respective feed paths of the webs of printing stock so as to compensate for differences in length of paths.

In another embodiment of the invention the draw-in elements are operative to draw in the printing stock webs at least occasionally at different speeds so that all printing stock webs arrive at and are stopped at the outputs of the printing unit simultaneously.

In still another embodiment, a plurality of rollers are arranged in the printing units or in an area prior to the printing units so as to be stationary and/or axially displaceable between the feed paths of the printing stock web to compensate for the differences in the length of the paths. A quantity of the rollers is provided which corresponds at most to the number of feed paths so that the printing stock webs are deflected over the rollers during a feed process.

In still another embodiment, the adjusting means includes an electronic computer and an electronic memory. A start initiator is provided in each of the reel changers for detecting the start of a respective draw-in element. The switch valves are connected with the electronic computer via signal lines and are adjustable by the electronic computer based on a path program contained in the electronic memory. The draw-in elements are located at the respective start initiators at the moment of starting and the start initiators are electromagnetically damped by the draw-in elements.

Yet a further embodiment provides that the reel changers are for stationary gluing. The start initiators are arranged downstream of the draw mechanisms in the feed direction for detecting start of the respective draw-in elements. Tile draw-in elements are located at the respective start initiators at the moment of starting and the start initiators are electromagnetically damped by the draw-in elements.

In still an additional embodiment, each feed path has at least one paper tear protection device with a severing device and an associated register roller situated in the feed path upstream of the paper tear protection device. The register roller is positioned so that before the draw-in element moves up to the register roller the printing stock web travels the longest possible distance so that the printing stock web does not hang down loosely or fall back.

Pursuant to this object, another aspect of the present invention resides in a method for feeding a plurality of printing stock webs with a draw-in device as described above, wherein the start initiators are electromagnetically damped with the draw-in elements and the switches are pneumatically adjusted according to the path program so that the main valves and the pressure lines associated with the different feed paths are opened successively at delayed times corresponding to the path difference and drive stations are switched on pneumatically for advancing the draw-in elements. Furthermore, the associated printing units are also switched on.

In still another embodiment of the inventive method the draw-in elements are moved around oscillating rollers in the reel changers while the oscillating rollers are stationary. Initiators arranged downstream of the oscillating rollers in the feed direction detect the start of the respective printing stock web after the draw-in element moves past. The oscillating rollers then control the braking force of the reel changers by means of a signal generated by the initiator so that these reel changers exert a reduced braking force on the printing stock webs during the draw-in process.

Still another embodiment of the inventive method for refeeding a printing stock web which has been torn during the print process into a printing machine with a plurality of printing units, including maintaining all the printing units coupled in when a tear has been detected, stopping all the printing stock webs, manually securing the start of the torn printing stock web to the respective draw-in element at the location of the tear and drawing the torn web along with the draw-in element until reaching the folding unit. The printing stock web in question is draw simultaneously by draw rollers which are individually driven electrically at identical speeds.

In still another embodiment of the inventive method for refeeding a torn printing stock web, all the printing units continue to rotate while decoupled after a tear has occurred. Only the torn printing stock web is manually attached to the respective draw-in element and is then moved farther while the rest of the printing stock webs remain stationary. The reel changers for the stationary printing stock webs are braked to a standstill for this purpose. The web tension on the printing stock webs which are not torn is reduced until they are loosely wrapped around the printing cylinder units and printing unit rollers. All the draw rollers associated with the printing stock webs that are not torn are stopped and the draw rollers associated with the torn printing stock web are electrically driven individually at identical speeds until the printing stock web is drawn into a respective folding unit.

The invention also has the object of providing methods for feeding new printing stock and methods for refeeding individual webs of printing stock which were torn during the print process which produces less waste and requires only a short time for the feed.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
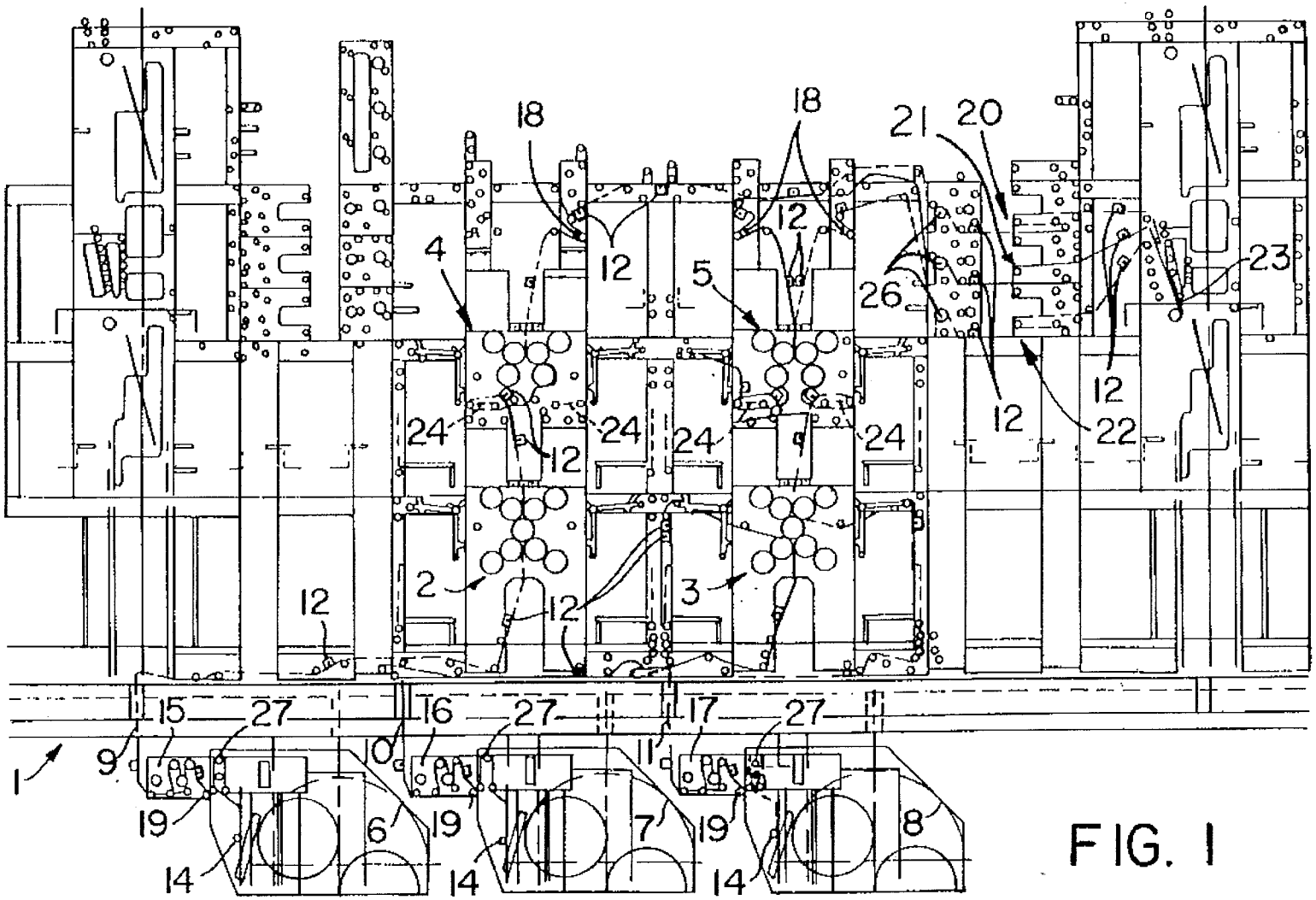
FIG. 1 shows a printing machine with a plurality of printing units arranged adjacent to one another and one above the other.

The printing machine 1 in FIG. 1 has satellite printing units 2, 3 and offset-type or rubber-on-rubber printing units 4, 5 arranged above the printing units 2, 3. Webs of printing stock must be fed through the printing machine by means of draw-in elements proceeding from reel changers 6, 7 and 8 via paths 9, 10, 11. The paths 9, 10, 11 are representative of a multitude of possible paths. For example, paths 9, 10, 11 are 31.1 meters, 44.7 meters and 26.7 meters, respectively.

An open-ended or finite draw-in element, preferably a roller chain or spring steel belt, running in guides alongside the feed paths 9, 10, 11 serves to draw in the webs of printing stock, preferably paper webs, from the reel changers 6, 7, 8. Drive stations 12 for the draw-in devices are provided alongside the feed paths 9, 10, 11.

The distances between the drive stations 12 are preferably dimensioned so that the draw-in elements are driven by at least one drive station 12. Thus, when the draw-in element moves out of the driving range of one drive station 12 it is already engaged at its other end by a new drive station 12.

The draw-in element is produced from a metallic, preferably ferromagnetic material in order to trigger a change in the magnetic flux in the drive stations 12 so that the motors of the drive stations 12 are switched on. Another possibility for switching on the motors of the drive stations 12 includes arranging pneumatic switching elements in the form of pneumatic sensors of known construction at fixed intervals upstream and downstream of the drive stations 12 (for both movement directions of the draw-in elements). The switching elements trigger a switching signal in the respective drive station 12 due to a change in pressure when a draw-in element passes by so that a compressed-air-motor is started in the drive station 12 and pulls or pushes the draw-in element until its edge is engaged by the next drive station.

The printing machine has an electronic memory in which all possible paths in the printing machine are stored. The memory is part of an electric computer, e.g. a microprocessor. The operator makes use of a control console, for example, to input all data or to interrogate the preselected paths or the positions of the draw-in elements. The operation of the draw-in device is controlled by a computer program. The program jumps back to its beginning when an off switch is activated; an oil switch initiates the program, triggering the movement of the draw-in elements at different times. A main valve which controls points or switches pneumatically in order to adjust different paths is still closed at this time. The switches are set in such a way that the operator selects a programmed path and a start initiator 14 is damped immediately in each of the different paths, e.g. the paths 9, 10, 11 shown in FIG. 1, by applying electric voltage. The start initiators 14 are located at the output of the reel changers 6, 7, 8 to draw mechanisms 15, 16, 17.

Figure 2:
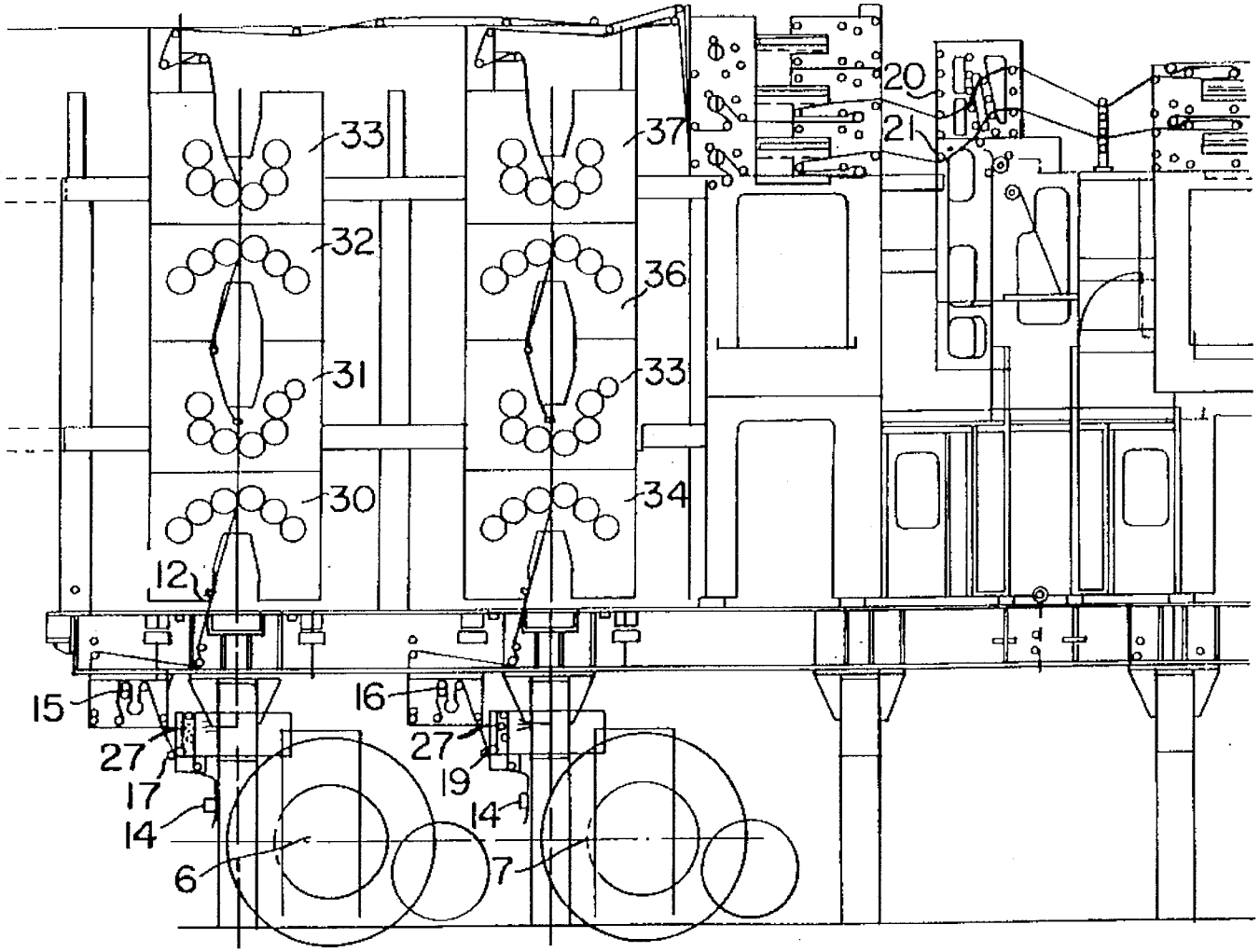
FIG. 2 shows a tower type printing machine with two printing unit towers.

The reel changers 6, 7, 8 shown in FIGS. 1, 2 are for a flying reel change in which the new webs of printing stock are glued to the terminating webs of printing stock during operation.

In printing machines, e.g., for picture printing, having a reel changer with stationary gluing and a paper supply for webs of printing stock arranged downstream of the reel changer, the draw-in device may first begin to feed downstream of the draw mechanism if desired, in which case the start initiators 14 are arranged at this location. Every printing unit 2 to 5 (FIG. 1) has paper tear protection devices, e.g. paper tear protection devices 18. Sheet cutters and associated register rollers 24 for changing the path length of the printing stock web are allocated to the paper tear protection devices 18 and lie upstream of the latter in the feed path. The paper tear protection devices 18 are damped electromagnetically only when paper which is optically registered is guided past them. Before the respective paper tear protection device 18 is damped by the draw-in element, the associated regulating roller 24 is positioned so that the printing stock web travels the longest possible distance. Only after the draw-in element has moved past the paper tear protection device 18 is the regulating roller 24 moved in the direction of its reference position, wherein the path of the printing stock web is gradually shortened. This prevents tearing of the printing stock web during the shortening of its running path due to a sudden jolt. In order to cover this distance, the regulating roller 24 requires, for example, as much time as is available for the entire feed process.

After the start initiators 14 are damped by the respective draw-in elements, the draw-in elements move around oscillating rollers 27 associated with the reel changers 6, 7, 8 and travel past an initiator 19 which is arranged downstream of the oscillating rollers 27 in the feed direction and registers the end of the draw-in element or the start of the printing stock web. The initiator 19 switches on the roller brake which is now controlled by the respective position of the oscillating roller. The amount of braking force applied to the printing stock web during the feed is less than compared with the printing process. The web of printing stock is now transported by the respective draw-in elements through the printing units 2 to 5 from the reel changers 6 to 8 to the respective folding units 20, 21 and 22. In accordance with the indicated path program, there is a delay between the start of the movement of the respective draw-in element for the different feed paths 9 to 11 relative to the longest feed path, in this case feed path 10. The draw-in elements and the webs of printing stock drawn along by them travel at a rate of 25 to 30 meters per minute during the feed. 1a1

When cutting rollers 26 are provided at the inlets to the folding units 20, 21, 22, the draw-in elements are stopped at the cutting rollers 26 or fed in until the folding slot or fold former of the respective folding unit 20, 21, 22. In so doing, the cutting knives of the cutting rollers 26 are stopped. If there are no cutting rollers 26, the draw-in elements are always fed up to the fold formers. The feed process is concluded as soon as the draw-in elements reach end initiators 23 which are arranged at such a distance between the cutting rollers 26 and the respective fold former that the start of the printing stock web stops just before the cutting roller 26 or in front of the fold former. When the end initiators 23 are damped, the main valve is closed and the drive stations 12 are stopped. As soon as the start of the printing stock web runs over the respective cutting roller 26, the cutting knife is advanced toward the cutting roller 26 so as to cut the printing stock web in half, one-half being guided manually via turning bars until the respective folding unit 20, 21 or 22.

If the end initiators 23 are not all damped simultaneously but rather at intervals of several seconds one after the other when a plurality of printing stock webs are led, it is sufficient to conclude the feed process already when the first end initiator 23 is damped. After the end initiators 23 have been damped, the main valve for the air feed is shut off and the drive stations 12 are stopped. The braking force for the reel changers 6 to 8 is increased to the standard value for the printing operation.

At the conclusion of the feed process, the draw-in elements, which are formed by a chain running in the rails of the feed path or by a cable and a draw-in tip for drawing the web of printing stock, are separated, i.e. the draw-in tip is removed from the feed path so that the chain can return to the reel changers 6, 7, 8 along the same feed path.

For the return of the chains or cable to the start initiators 14, the main valve is turned on again and the motors of the drive stations 12 now move in the opposite direction.

When only one web is being fed, the chain of the individual draw-in elements is drawn back to the corresponding start initiator 14. As soon as the latter is damped, the main valve is closed and the motors of the drive stations 12 are stopped. This concludes the feed process and all buttons on the control console are in the off position and the printing machine is free for printing operations.

In the event that a plurality of paper webs are to be fed in jointly, the chains start simultaneously when returning to the end initiators 23. However, they arrive at the start initiators 14 at different times in accordance with the length of the different paths 9, 10, 11. As a result, only the start initiators 14 of the paper webs in question are damped. Thus, in the embodiment shown, the start initiator 14 in reel changer 8 is damped first, then the start initiator 14 in reel changer 6 and finally the start initiator 14 of reel changer 7.

In a corresponding manner, only the drive stations 12 associated with paths 11, 9 and 10 are switched off. The rest of the drive stations 12 are shut off and the main valve closed only when the start initiator 14 of reel changer 7 is also clamped. As in the case of individual web feed, all buttons on the control console are now turned off and the printing machine is free to carry out all printing operations.

According to the present invention, it is also possible for a web of printing stock which has been torn during the print process to be fed in again, but under the condition that the printing stock webs are drawn in around fewer cylinders of the printing units, e.g., as in a four-tower or eight-tower printing unit. The printing units 30 to 33 and 34 to 37 shown in FIG. 2 are arranged in printing unit towers in which the printing stock webs pass around fewer cylinders. As soon as a tear in one of the printing stock webs is registered by a sensor, all printing units remain coupled in.

After the torn piece of the printing stock web has been removed, the chain of the draw-in element associated with the torn printing stock is moved up to the location of the tear so that the draw-in tip can be attached to the chain and connected with the start of the printing stock web. The draw-in element is then moved together with the web to the respective folding unit 20, 21 or 22 in the manner described above. Thus, in this printing machine all draw rollers 24 must be drivable individually and at the same speed so that only the draw rollers 24 associated with the torn printing stock web are driven in order to support the feed process, while the draw rollers 24 associated with the printing stock webs which are not torn are stopped. This may be effected, for example, by means of individual electric drives.

Another possibility, by which printing stock webs torn during the print process may be drawn in again individually without generating unnecessary waste by simultaneously drawing in the printing stock webs which are not torn, consists in continuing the running of all printing units 2 to 5 after the web has been torn, but uncoupling the relevant draw rollers 24 so that the printing stock webs hang loosely in the printing units and are tightly looped around neither the draw roller 24 nor the cylinders. In this way, the printing stock webs are not moved farther. Immediately thereafter, the reel changers 6 to 8 are likewise braked to a standstill. Then the chain of the draw-in element is moved again to the start of the torn printing stock web at the location of the tear, the draw-in tip is connected with the start of the printing stock web, as described above, and is drawn up to the associated folding unit 20, 21 or 22. At the same time, the printing stock web is drawn by the draw roller 24 associated with its feed path, while draw rollers 24 which are located in the feed paths of the printing stock webs which are not torn remain at a standstill until the conclusion of the feed process. The reel changer associated with the printing stock web to be drawn in produces only a low web tension during the feed process and its brake or its belt is controlled by the associated oscillating roller 27 during the feed process. The rest of the reel changers are then also switched on again and their web tensions are increased until reaching the predetermined reference value.

According to the present invention, a draw-in device is provided for drawing in a plurality of printing stock webs, preferably paper webs, in which draw-in elements of finite length grasp the start of a paper web and draw the latter out of the reel changers 6 to 8 and draw mechanisms 15 to 17 through the printing units 2 to 5 to the folding units 20 to 22. There is less wasted stock compared with conventional draw-in devices in that an electronic memory is provided in which the lengths of all possible feed paths 9 to 11 in the printing machine are stored and the draw-in elements can be switched on at different times and switched off simultaneously via an electronic computer connected with the memory in accordance with the differences in length of the feed paths 9 to 11 and the resulting time differences at a given feed rate. It is also possible for a printing stock web torn during the print process to be drawn in again while substantially reducing wasted stock. Rather than starting the draw-in elements at different times, it is also possible to start them simultaneously and to draw them in at different feed rates so that they arrive at the same time (within allowable tolerances with respect to time). In another alternative, differences in length of path are compensated for by additional rollers around which the printing stock webs must travel.

The invention is not limited by the embodiments described above which are presented as examples only but can be modified in various ways within the scope of protection defined by the appended patent claims.

We claim:

1. A draw-in device for drawing a plurality of webs of printing stock along different feed paths of different length formed by guides and switches lying outside a roller area from reel changers and draw mechanisms into printing units of a printing machine, comprising: draw-in elements of finite length; and, adjusting means for adjusting the feed paths so that the draw-in elements can draw in the printing stock webs on respective feed paths so that leading ends of all the webs arrive simultaneously at the end of their respective feed path.

2. A draw-in device according to claim 1, wherein the draw-in elements are operative to draw in the printing stock webs at least occasionally at different speeds so that all printing stock webs simultaneously arrive at and stop at outputs of the printing units.

3. A draw-in device according to claim 2, wherein the reel changers are flying reel changers, the adjusting means including an electronic computer and an electronic memory, and further comprising start initiator means provided in each of the reel changers for detecting a start of a respective draw-in element, valves for the switches being connected with the electronic computer and being adjustable by the electronic computer based upon a path program contained in the electronic memory, the draw-in elements being located at respective start initiator means at a moment of starting so as to be electromagnetically damped by the draw-in elements.

4. A draw-in device according to claim 2, wherein the adjusting means include an electronic computer and an electronic memory, the reel changers being of a type intended for stationary gluing with downstream paper stores for the printing stock web, and further comprising a separate start initiator for each reel changer, the initiator being arranged in each instance downstream of the draw mechanisms in a feed direction so as to detect a start of the respective draw-in element, the switch valves being connected with the electronic computer and adjusted by the computer based upon a path program contained in the electronic memory, the draw-in elements being located at the respective start initiators at a point of starting and so as to electromagnetically damp the draw-in elements.

5. A draw-in device according to claim 2, and further comprising paper tear protection means arranged in each feed path and including a severing device, a register roller being arranged in the feed path upstream of the paper tear protection means and being positioned so that prior to movement of an associated draw-in element up to the register roller the printing stock web travels a longest possible path so that the priming stock web does not hang down loosely or fall back.

6. A draw-in device according to claim 1, and further comprising a plurality of rollers arranged one of in the printing units and in an area prior to the printing units so as to be at least one of stationary and axially displaceable between the feed paths of the priming stock webs to compensate for the differences in length of the paths, the rollers being of a number that corresponds at most to the number of feed paths so that the printing stock webs are deflected over the rollers during feeding.

7. A draw-in device according to claim 6, wherein the reel changers are flying reel changers, the adjusting means including an electronic computer and an electronic memory, and further comprising start initiator means provided in each of the reel changers for detecting a start of a respective draw-in clement, valves for the switches being connected with the electronic computer and being adjustable by the electronic computer based upon a path program contained in the electronic memory, the draw-in elements being located at respective start initiator means at a moment of starting so as to be electromagnetically damped by the draw-in elements.

8. A draw-in device according to claim 6, wherein the adjusting means include an electronic computer and an electronic memory, the reel changers being of a type intended for stationary gluing with downstream paper stores for the printing stock web, and further comprising a separate start initiator for each reel changer, the initiator being arranged in each instance downstream of the draw mechanisms in a feed direction so as to detect a start of the respective draw-in element, the switch valves being connected with the electronic computer and adjusted by the computer based upon a path program contained in the electronic memory, the draw-in elements being located at the respective start initiators at a point of starting and so as to electromagnetically damp the draw-in elements.

9. A draw-in device according to claim 6, and further comprising paper tear protection means arranged in each feed path and including a severing device, a register roller being arranged in the feed path upstream of the paper tear protection means and being positioned so that prior to movement of an associated draw-in element up to the register roller the priming stock web travels a longest possible path so that the printing stock web does not hang down loosely or fall back.

10. A draw-in device for drawing a plurality of webs of printing stock along different feed paths of different length formed by guides and switches lying outside a roller area from reel changers and draw mechanisms into printing units of a printing machine, comprising: draw-in elements of finite length; and, adjusting means for adjusting the feed paths so that the draw-in elements can draw in the printing stock webs on respective feed paths, the draw-in elements being startable at different times corresponding to the differences in length of the feed paths and the resulting time differences at given feed rates as controlled by the adjusting means, the draw-in elements being operative to first draw in the operating stock web traveling a longest feed path and last a printing stock web traveling a shortest feed path so that all printing stock webs simultaneously arrive at and stop at outputs of the printing units.

11. A draw-in device according to claim 10, wherein the reel changers are flying reel changers, the adjusting means including an electronic computer and an electronic memory, and further comprising start initiator means provided in each of the reel changers for detecting a start of a respective draw-in element, valves for the switches being connected with the electronic computer and being adjustable by the electronic computer based upon a path program contained in the electronic memory, the draw-in elements being located at respective start initiator means at a moment of starting so as to be electromagnetically damped by the draw-in elements.

12. A draw-in device according to claim 10, wherein the adjusting means include an electronic computer and an electronic memory, the reel changers being of a type intended for stationary gluing with downstream paper stores for the printing stock web, and further comprising a separate start initiator for each reel changer, the initiator being arranged in each instance downstream of the draw mechanisms in a feed direction so as to detect a start of the respective draw-in element, the switch valves being connected with the electronic computer and adjusted by the computer based upon a path program contained in the electronic memory, the draw-in elements being located at the respective start initiators at a point of starting and so as to electromagnetically damp the draw-in elements.

13. A draw-in device according to claim 10, and further comprising paper tear protection means arranged in each feed path and including a severing device, a register roller being arranged in the feed path upstream of the paper tear protection means and being positioned so that prior to movement of an associated draw-in element up to the register roller the printing stock web travels a longest possible path so that the printing stock web does not hang down loosely or fall back.

14. A method for feeding a plurality of printing stock webs along different feed paths of different lengths with a draw-in device having draw-in elements of finite length, and, adjusting means for adjusting the feed paths so that the draw-in elements can draw in the printing stock webs on respective feed paths, the draw-in elements being operative to draw in the printing stock webs at least occasionally at different speeds so that all printing stock webs simultaneously arrive at and stop at outputs of the printing units, the adjusting means including an electronic computer and an electronic memory, and further comprising start initiator means provided in each of the reel changers for detecting a start of a respective draw-in element, valves for the switches being connected with the electronic computer and being adjustable by the electronic computer based upon a path program contained in the electronic memory, the draw-in elements being located at respective start initiator means at a moment of starting so as to be electromagnetically damped by the draw-in elements, the method comprising the steps of: electromagnetically damping the start initiators with the draw-in elements, pneumatically adjusting the switches according to the path program so that successively at delayed times corresponding to the path difference main valves in pressure lines associated with different feed paths are opened and drive stations are switched on pneumatically for advancing the draw-in elements and the associated printing units are switched on.

15. A method for feeding a plurality of printing stock webs in a draw-in device along different feed webs of different length, which draw-in device includes draw-in elements of finite length and adjusting means for adjusting the feed paths so that the draw-in elements can draw in the printing stock webs on respective feed paths, the method comprising the steps of: moving the draw-in elements around oscillating rollers arranged in the feed changers while maintaining oscillating rollers stationary; arranging initiators downstream of the oscillating rollers in the feed direction for detecting the start of the respective printing stock web after the draw-in element moves passed; and controlling a braking force of the reel changers via the oscillating rollers by way of a signal generated by the initiators so that the reel changers exert a reduced braking force on the printing stock webs during draw-in.

16. A method according to claim 15, and further comprising the step of refeeding a printing stock web which has been torn during a print process with the draw-in device into a printing machine having a plurality of printing units in which priming stock webs are printed on a plurality of feed paths, the refeeding step including: detaching a tear; maintaining all the printing units coupled in when a tear is detected; stopping all priming stock webs; manually securing a start of the torn printing stock web to a respective draw-in element of the draw-in device at a location of the tear; drawing the torn printing stock web along with the draw-in element until reaching a folding unit; and simultaneously drawing the web in question with draw rollers which are individually driven electrically at identical speed.

17. A method according to claim 15, and further comprising the step of refeeding a printing stock web which has been torn during a printing process into a printing machine with a plurality of printing units having cylinders and rollers and in which printing stock webs are printed on a plurality of feed paths, the refeeding step including: continuing rotation of all printing units while coupled in after a tear has occurred in the web; manually attaching only the torn printing stock web to be fed in again to a respective draw-in element; moving the torn priming stock farther while maintaining the remaining printing stock web stationary; braking reel changers for the stationary printing stock webs to a standstill; reducing web tension on the printing stock webs which are not torn until they are loosely wrapped around the printing unit cylinders and printing unit rollers; stopping draw rollers associated with the printing stock webs that are not torn; and electrically driving draw rollers associated with the torn printing stock web individually at identical speeds until the printing stock web is drawn into a respective folding unit.

* * * * *